US012687174B2

(12) United States Patent
Wang

(10) Patent No.: US 12,687,174 B2
(45) Date of Patent: Jul. 21, 2026

(54) INFLATABLE PUMP

(71) Applicant: Wei-Chi Wang, Tainan City (TW)

(72) Inventor: Wei-Chi Wang, Tainan City (TW)

( * ) Notice: Subject to any disclaimer, the term of this patent is extended or adjusted under 35 U.S.C. 154(b) by 0 days.

(21) Appl. No.: 19/019,363

(22) Filed: Jan. 13, 2025

(65) Prior Publication Data

US 2026/0201899 A1 Jul. 16, 2026

(51) Int. Cl.
*F04D 17/16* (2006.01)
*F04D 29/42* (2006.01)

(52) U.S. Cl.
CPC ..... *F04D 29/4226* (2013.01); *F04D 17/16* (2013.01)

(58) Field of Classification Search
CPC ..... F04D 29/4226; F04D 17/16
See application file for complete search history.

(56) References Cited

U.S. PATENT DOCUMENTS 7,588,425 B2 * 9/2009 Chung ..... A47C 27/082 5/713
8,235,684 B2 * 8/2012 Song ..... F04D 25/08 5/713
11,268,529 B2 * 3/2022 Huang ..... F04D 27/005
11,668,312 B2 * 6/2023 Huang ..... F04D 25/166 417/315
11,988,216 B2 * 5/2024 Li ..... F04D 27/003
2015/0308454 A1 * 10/2015 Shi ..... F04D 27/008 415/151
2016/0123349 A1 * 5/2016 Wang ..... F04D 29/4226 415/175
2021/0003120 A1 * 1/2021 Huang ..... F04B 23/06

* cited by examiner

*Primary Examiner* — Nathaniel E Wiehe
*Assistant Examiner* — Theodore C Ribadeneyra
(74) *Attorney, Agent, or Firm* — Apex Juris, pllc; Hilde M. L. Coeckx

(57) ABSTRACT

An inflatable pump has a housing and a core disposed in the housing. The housing has a core chamber, an inlet at an end of the core chamber, a fan chamber with a volute chamber at the other end of the core chamber, and an outlet fluidly communicating with the fan chamber. The core is disposed in the core chamber and a fan wheel of an electric motor thereof is disposed in the fan chamber. When the electric motor is turned on, the fan wheel is driven to spin to direct air entering the housing from the inlet. Heat around the core is carried by the air passing the core and is directed into the volute chamber of the fan chamber, and is rapidly cast out from the housing via the outlet by a vortical flow generated by the rotation of the fan wheel in the volute chamber.

16 Claims, 14 Drawing Sheets

INFLATABLE PUMP

BACKGROUND OF THE INVENTION

1. Field of the Invention

The present invention relates to an inflatable device configured to inflate objects, such as tires, balls, etc., and more particularly to an electric inflatable pump.

2. Description of Related Art

A conventional electric inflatable pump configured to inflate objects, such as tires, balls, etc., substantially comprises a housing, a core disposed in the housing, and a battery electrically connected to and providing electrical power to the core. The core comprises a base, an electric motor disposed at a bottom of the base, a cylinder mounted at a side of the base, and a piston rod disposed in the cylinder. A shaft of the electric motor extends to a top of the base and is connected to an end of the piston rod with a gear set. An inflation adapter with a check valve is disposed at an end of the cylinder. A fan is disposed at a rotor of the electric motor, so during the movement of the piston rod driven by the electric motor, the fan is driven to rotate to generate an air flow. Therefore, heat generated by the core of the inflatable pump is cast out of the housing with the air flow via ventilation holes of the housing.

The inflatable pump is a device to provide compressed air to inflate objects. However, lots of heat will be generated during the movement of the piston rod of the core of the inflatable pump to compress air in the cylinder and during the operation of the electric motor. Since in the conventional inflatable pump, the core and the battery are both disposed in the housing without good separation, and a suitable guiding structure arranged in the housing for guiding the air flow generated by the fan is not available. The effect of the heat dissipation provided by the air flow is poor. Consequently, service life of the core of the inflatable pump is reduced with high operation temperature. The heat generated by the operating core may affect safety of the battery.

To overcome the shortcomings, the present invention provides a housing of an inflatable pump and an inflatable pump to mitigate or obviate the aforementioned problems.

SUMMARY OF THE INVENTION

The main objective of the present invention is to provide a housing of an inflatable pump and an inflatable pump that can guide an air flow properly to improve the heat dissipation of said pump.

The housing of the inflatable pump comprises a separating wall formed in the housing to separate an interior of the housing into a storage chamber, a core chamber, and a fan chamber.

An inlet is formed through a side of the housing and fluidly communicates with the core chamber at one of two ends of the core chamber. An outlet is formed through another side of the housing and fluidly communicates with the fan chamber. The fan chamber fluidly communicates with the core chamber at the other one of the two ends of the core chamber. A volute chamber facing toward the outlet is formed in the fan chamber. The inlet fluidly communicates with the outlet via the core chamber and the fan chamber to form a flowing passage in the housing.

The inflatable pump comprises a housing and a core. The housing comprises a separating wall formed in the housing to separate an interior of the housing into a storage chamber, a core chamber, and a fan chamber. An inlet is formed through a side of the housing and fluidly communicates with the core chamber at one of two ends of the core chamber. An outlet is formed through another side of the housing and fluidly communicates with the fan chamber. The fan chamber fluidly communicates with the core chamber at the other one of the two ends of the core chamber. A volute chamber facing toward the outlet is formed in the fan chamber. The inlet fluidly communicates with the outlet via the core chamber and the fan chamber to form a flowing passage in the housing. The core is disposed in the core chamber of the housing and extends into the fan chamber. The core comprises a casing base, a casing cover, an electric motor, a piston rod, a transmission set, an inflation adapter, and a fan wheel. The casing base comprises a base portion, a rear portion formed at one of two ends of the base portion, a transmission space formed between the rear portion and the base portion, a cylinder portion with a connection end portion formed at the rear portion and extending away from the base portion, and two triangular sidewall portions respectively formed at two opposite sides of the transmission space and between the base portion and the rear portion. The two triangular sidewall portions extend from the rear portion to the other one of the two ends of the base portion. The casing cover is detachably and tightly disposed on the casing base and closes the transmission space. The electric motor is disposed at the base portion of the casing base and comprises a rotor having one of two ends extending into the transmission space of the casing base. The piston rod is disposed in the cylinder portion of the casing base and extends into the transmission space of the casing base. The transmission set is disposed in the transmission space of the casing base and is connected between the piston rod and the rotor of the electric motor. The inflation adapter is disposed at the connection end portion of the cylinder portion of the casing base. The fan wheel is disposed in the volute chamber in the fan chamber of the housing and disposed at the other one of the two ends of the rotor of the electric motor.

Other objects, advantages and novel features of the invention will become more apparent from the following detailed description when taken in conjunction with the accompanying drawings.

DETAILED DESCRIPTION OF THE PREFERRED EMBODIMENT

The present invention provides a housing of an inflatable pump and an inflatable pump with said housing. The specific structures of the housing and the inflatable pump are described as follows.

Figure 1:
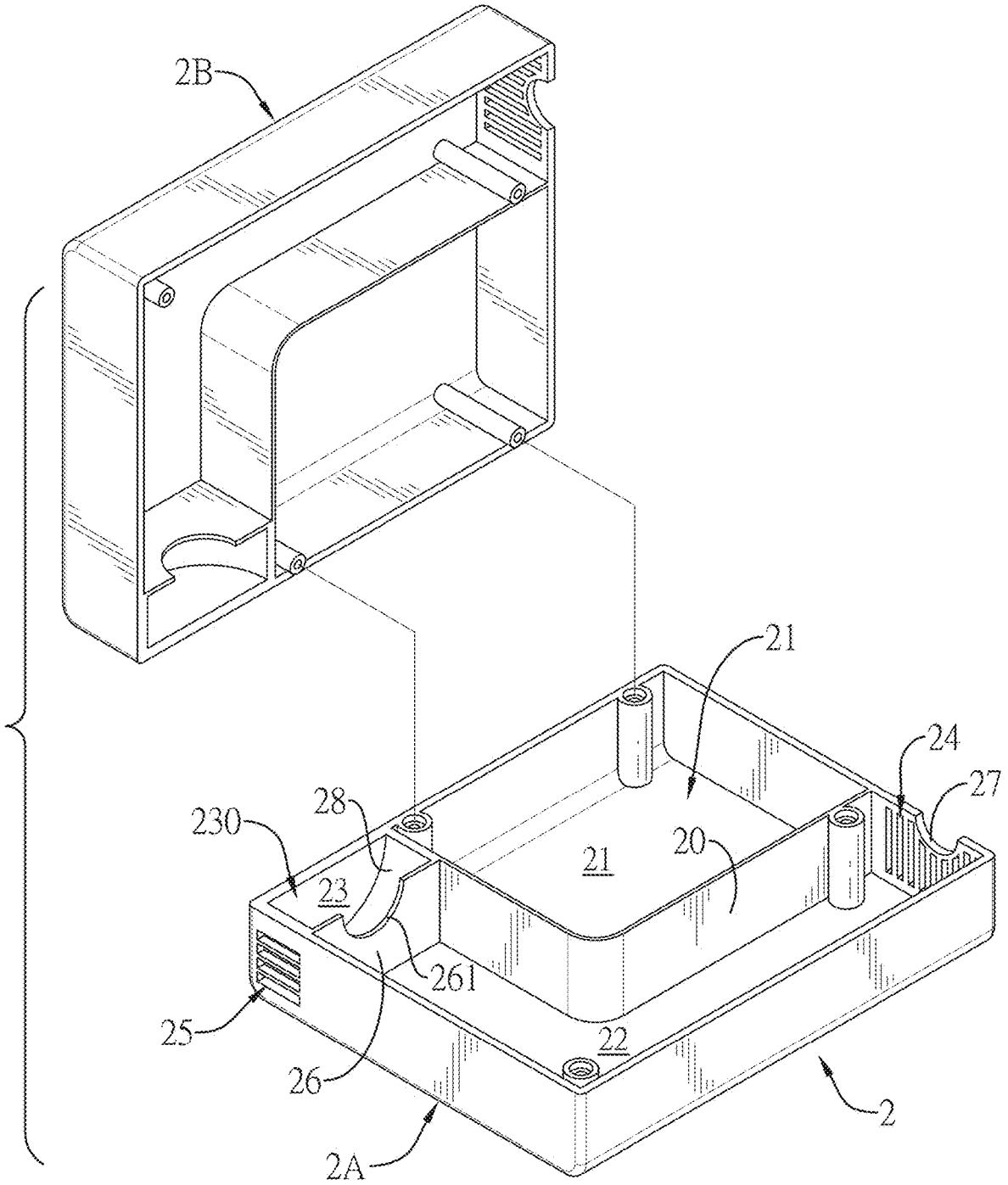
FIG. 1 is an exploded perspective view of a first embodiment of a housing of an inflatable pump in accordance with the present invention.
Figure 6:
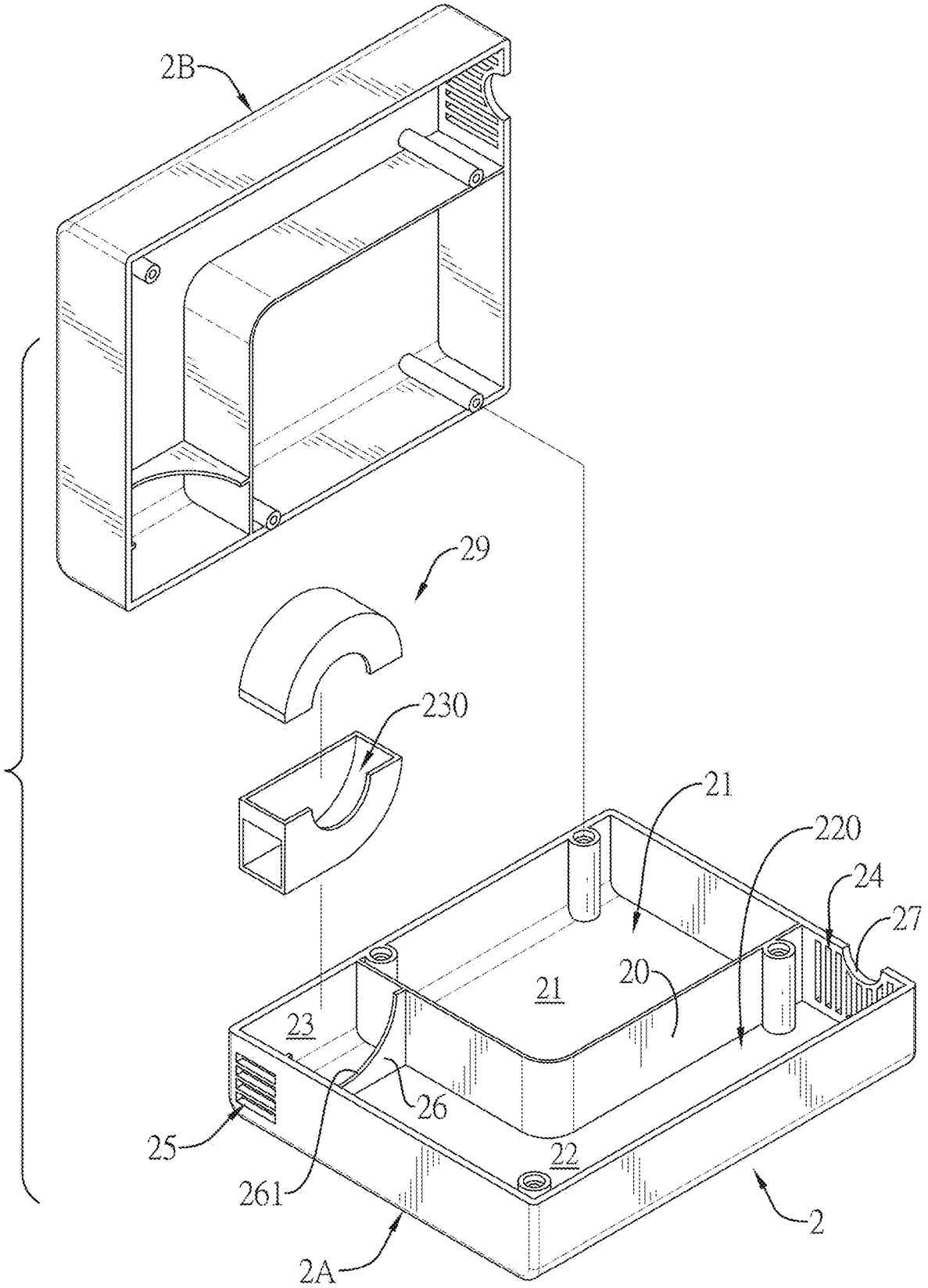
FIG. 6 is an exploded perspective view of a second embodiment of a housing of an inflatable pump in accordance with the present invention.

With reference to FIGS. 1 and 6, a first embodiment and a second embodiment of housings 2 of inflatable pumps in accordance with the present invention are shown. The housing 2 comprises multiple housing part 2A, 2B detachably assembled with one another. In the first or the second embodiment, the housing 2 comprises two housing parts 2A, 2B connected to each other. The two housing parts 2A, 2B may be secured with each other via bolts or snap-fit joints. In addition, the housing 2 may comprise a housing body and a housing cover connected to the housing body. The housing cover is secured on the housing body via bolts or snap joints. It is not limited thereto.

With reference to FIGS. 1 and 6, a separating wall 20 is formed in the housing 2 to separate an interior of the housing 2 into a storage chamber 21, a core chamber 22, and a fan chamber 23. The storage chamber 21 and the core chamber 22 are blocked by the separating wall 20 to reduce heat transfer between the storage chamber 21 and the core chamber 22. The housing 2 has an inlet 24 and an outlet 25 formed through respective two sides of the housing 2. The inlet 24 fluidly communicates with the core chamber 22 at an end thereof. The fan chamber 23 fluidly communicates with the core chamber 22 at the other end thereof. The outlet 25 fluidly communicates with the fan chamber 23. A volute chamber 230 facing toward the outlet 25 is formed in the fan chamber 23. A flowing passage 220, extending from the inlet 24, through the core chamber 22 and the volute chamber 230 of the fan chamber 23, and to the outlet 25, is formed in the housing 2. The housing 2 further comprises a through hole 27 formed through the side of the housing 2 with the inlet 24 and fluidly communicating with the core chamber 22. The through hole 27 and the inlet 24 are adjacent to and spaced apart from each other or the through hole 27 and the inlet 24 may be arranged at two adjacent sides the housing 2.

With reference to FIGS. 1 and 6, a partition wall 26 is formed between the fan chamber and the core chamber 22. A communication hole 261 is formed through the partition wall 26, so the fan chamber 23 fluidly communicates with the core chamber 22 via the communication hole 261. With reference to FIG. 1, an internal surface of the fan chamber 23 of the housing 2 is formed as a volute guide plate 28. The volute chamber 230 facing toward the outlet 25 is formed within the volute guide plate 28. With reference to FIG. 6, a volute wind cover 29 is disposed in the fan chamber 23. The volute chamber 230 facing toward the outlet 25 is formed within the volute wind cover 29. With reference to FIGS. 1 and 6, the volute guide plate 28 and the volute wind cover 29 may both include separating parts to be assembled with each other corresponding to the housing 2 with multiple housing parts.

With reference to FIGS. 2 to 5, 7 and 8, a core 1 of the inflatable pump is disposed in the housing 2. A fan wheel 16 of the core 1 is disposed in the volute chamber 230 of the fan chamber 23. When the fan wheel 16 is driven to spin, cool air can be directed into the housing 2 via the inlet 24, and flows through the core 1 to carry heat around an external surface of the core 1. The air with heat is directed from the core chamber 22 to the volute chamber 230 of the fan chamber 23. The air with heat can be efficiently exhausted out of the housing 2 via the outlet 25 with a vortical flow generated by the fan wheel 16 in the volute chamber 230. The cooling efficiency is enhanced by the arrangement of the housing 2 and the fan wheel 16.

Figure 2:
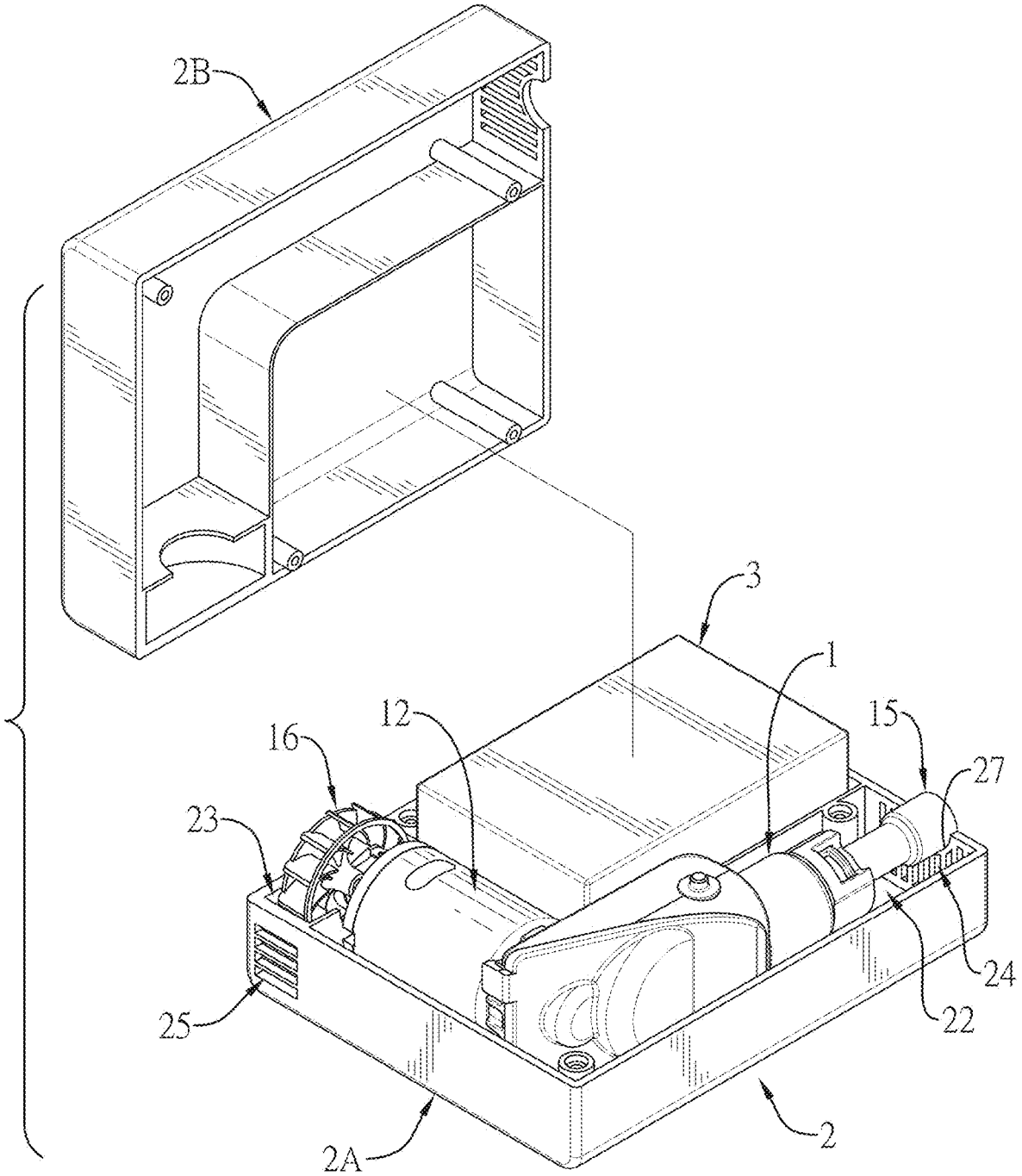
FIG. 2 is an exploded perspective view of the housing in FIG. 1 assembled with a core and a power storage unit to constitute the inflatable pump.
Figure 3:
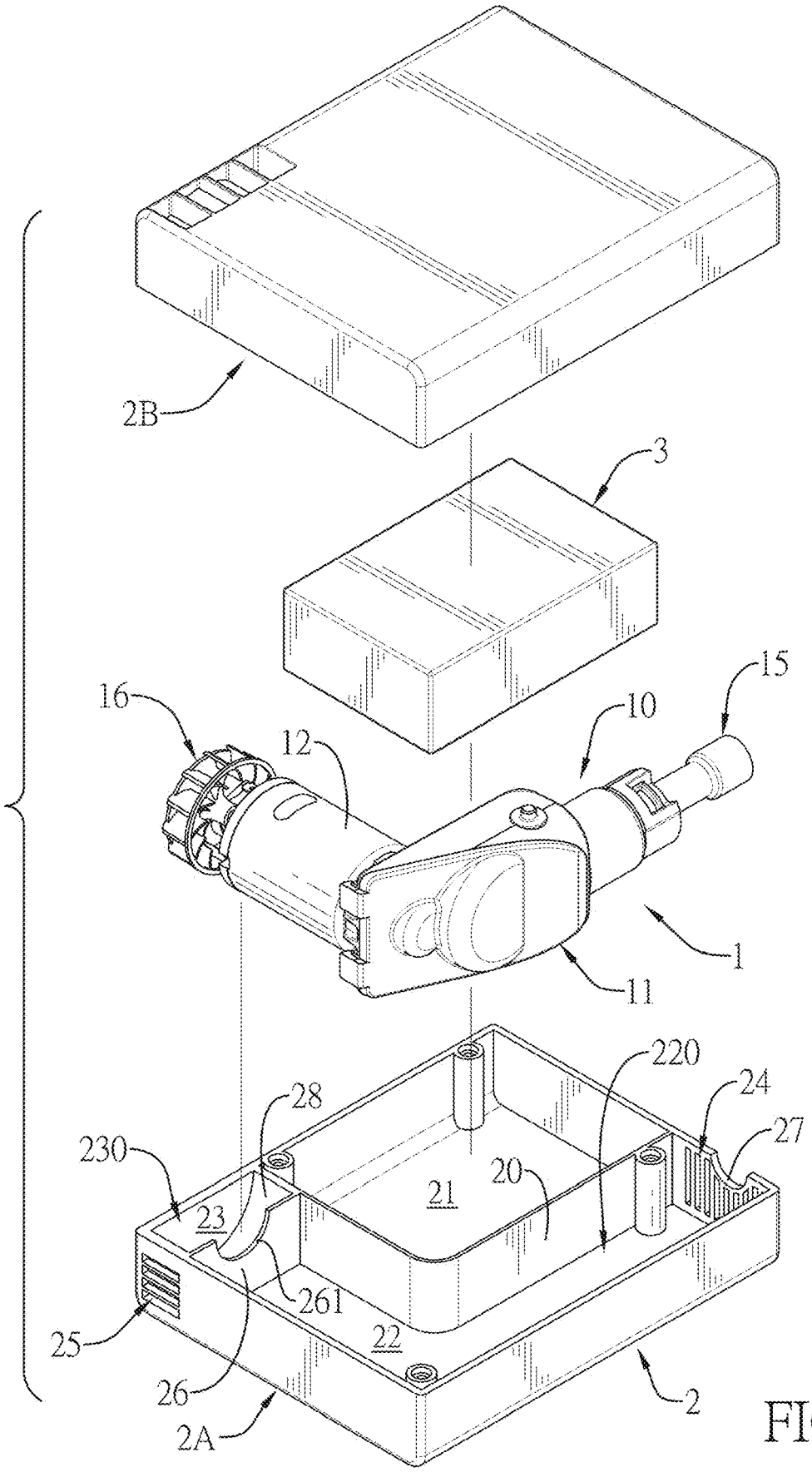
FIG. 3 is an exploded perspective view of the inflatable pump in FIG. 2.
Figure 4:
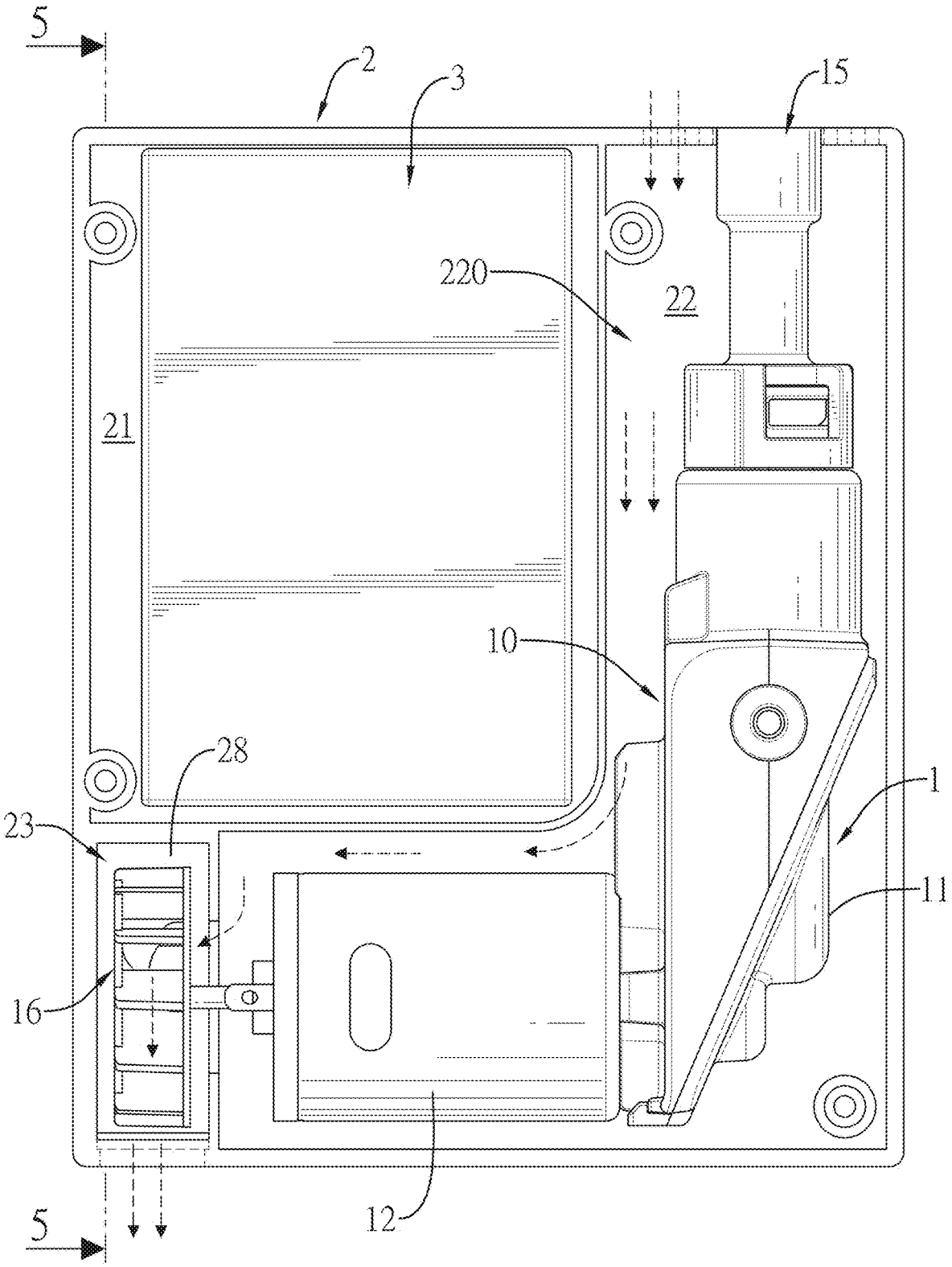
FIG. 4 is a plane view of the inflatable pump in FIG. 2, wherein an upper housing part is omitted.
Figure 5:
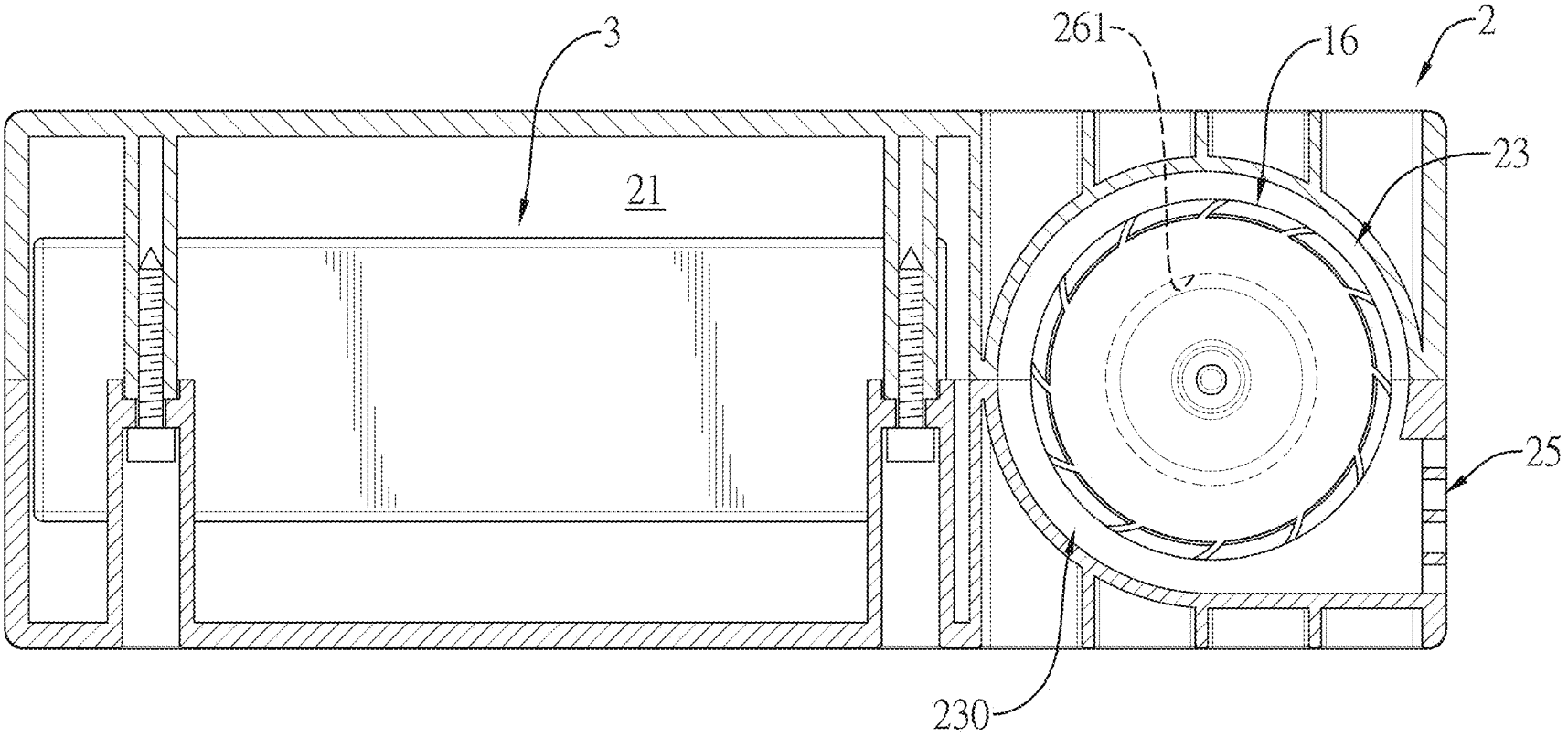
FIG. 5 is a side view in partial section of the inflatable pump across line 5-5 in FIG. 4.
Figure 7:
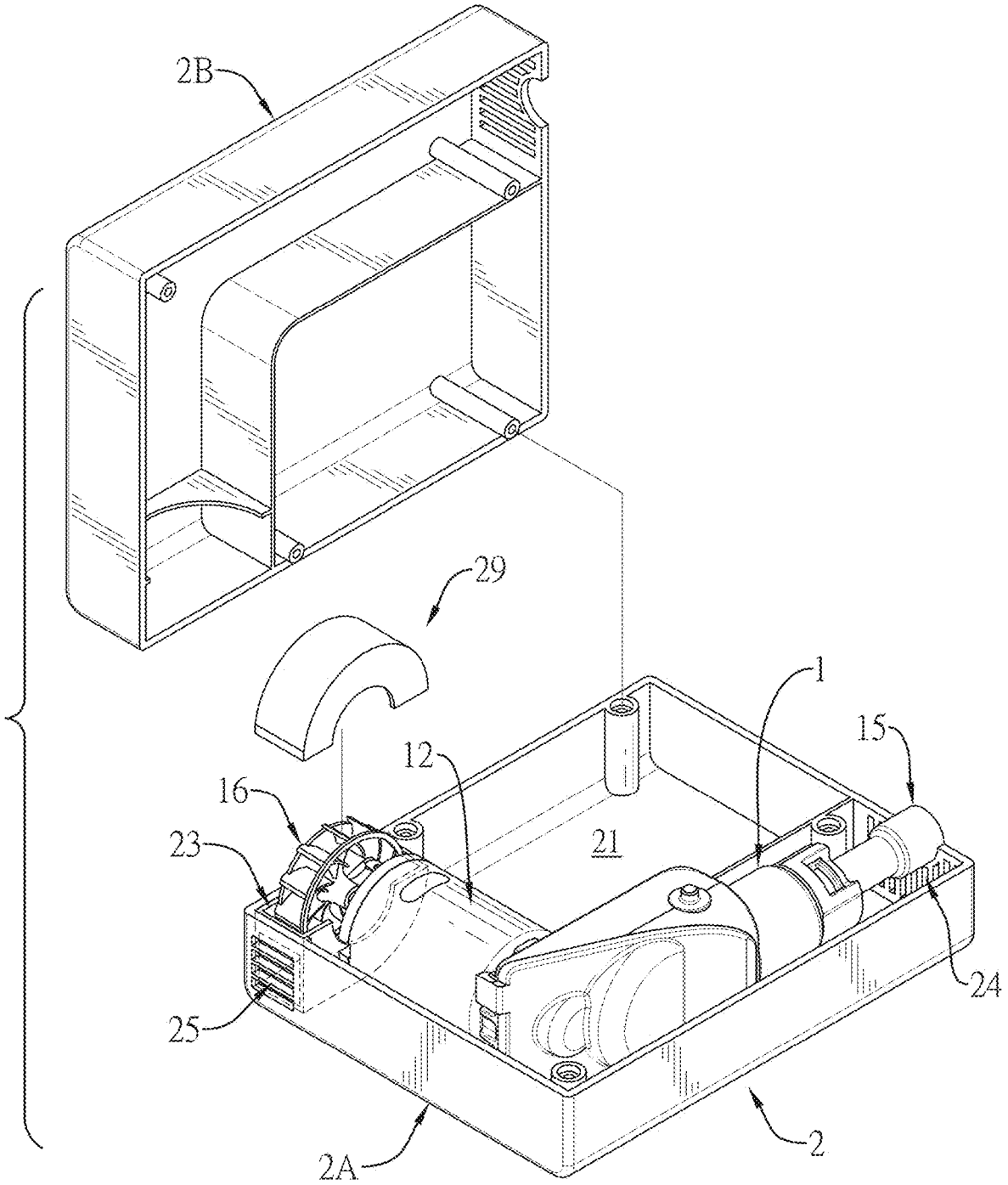
FIG. 7 is an exploded perspective view of the housing in FIG. 6 assembled with a core and a power storage unit to constitute the inflatable pump.
Figure 8:
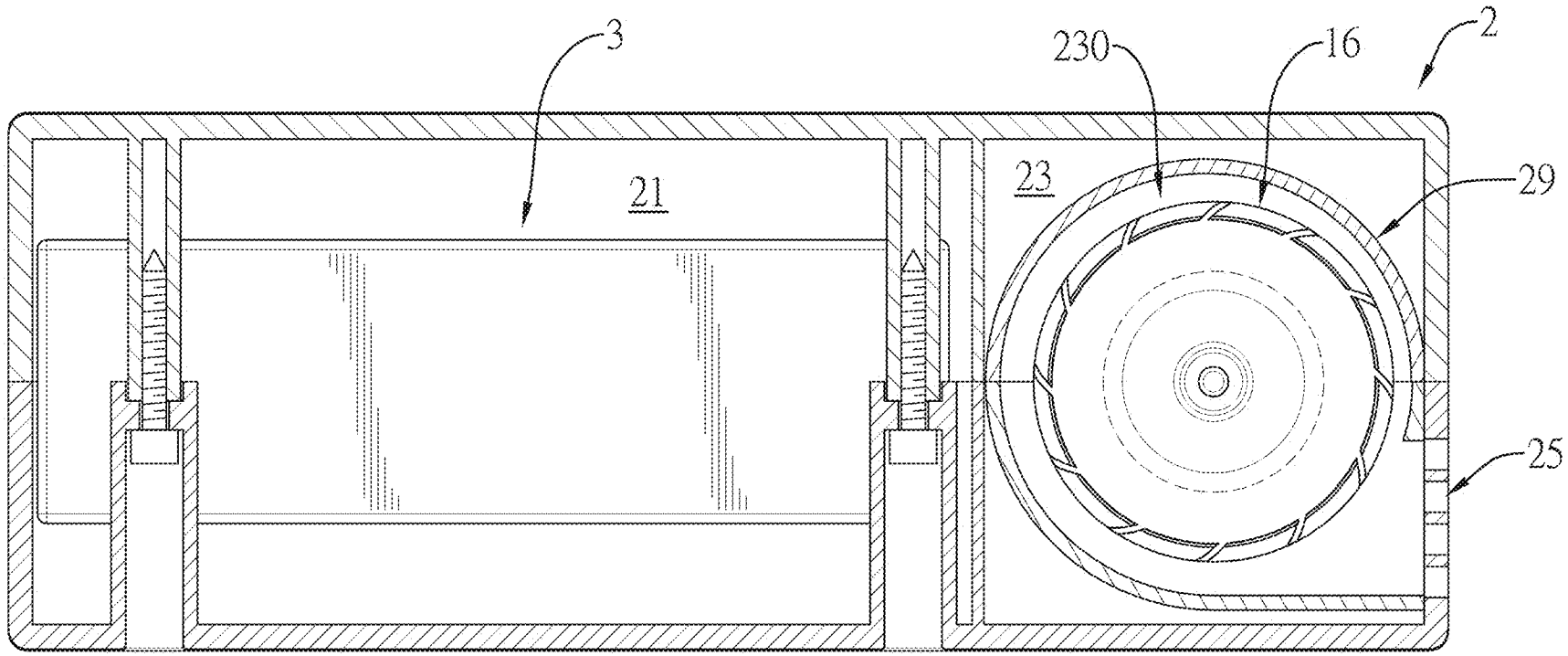
FIG. 8 is a cross sectional side view of the inflatable pump in FIG. 7.

With reference to FIGS. 2, 3, and 7, the first and the second embodiments of the inflatable pumps in accordance with the present invention are shown. The inflatable pump comprises a housing 2 and a core 1, or further comprises a power storage unit 3 or an electric cable with plug. The structure of the housing 2 is mentioned above and details thereof are omitted. The core 1 is disposed in the core chamber 22 of the housing 2 and extends into the fan chamber 23. The power storage unit 3 may be a rechargeable battery and is disposed in the storage chamber 21. A switch may be disposed at the housing 2, electrically connected to the power storage unit 3 and the core 1, and configured to switch on and off the core 1. In addition, if no power storage unit is disposed in the storage chamber 21 of the housing 2, the electric cable connected to the core 1 may be partially placed in the storage chamber 21 and is electrically connected to a power source for providing power.

Figure 9:
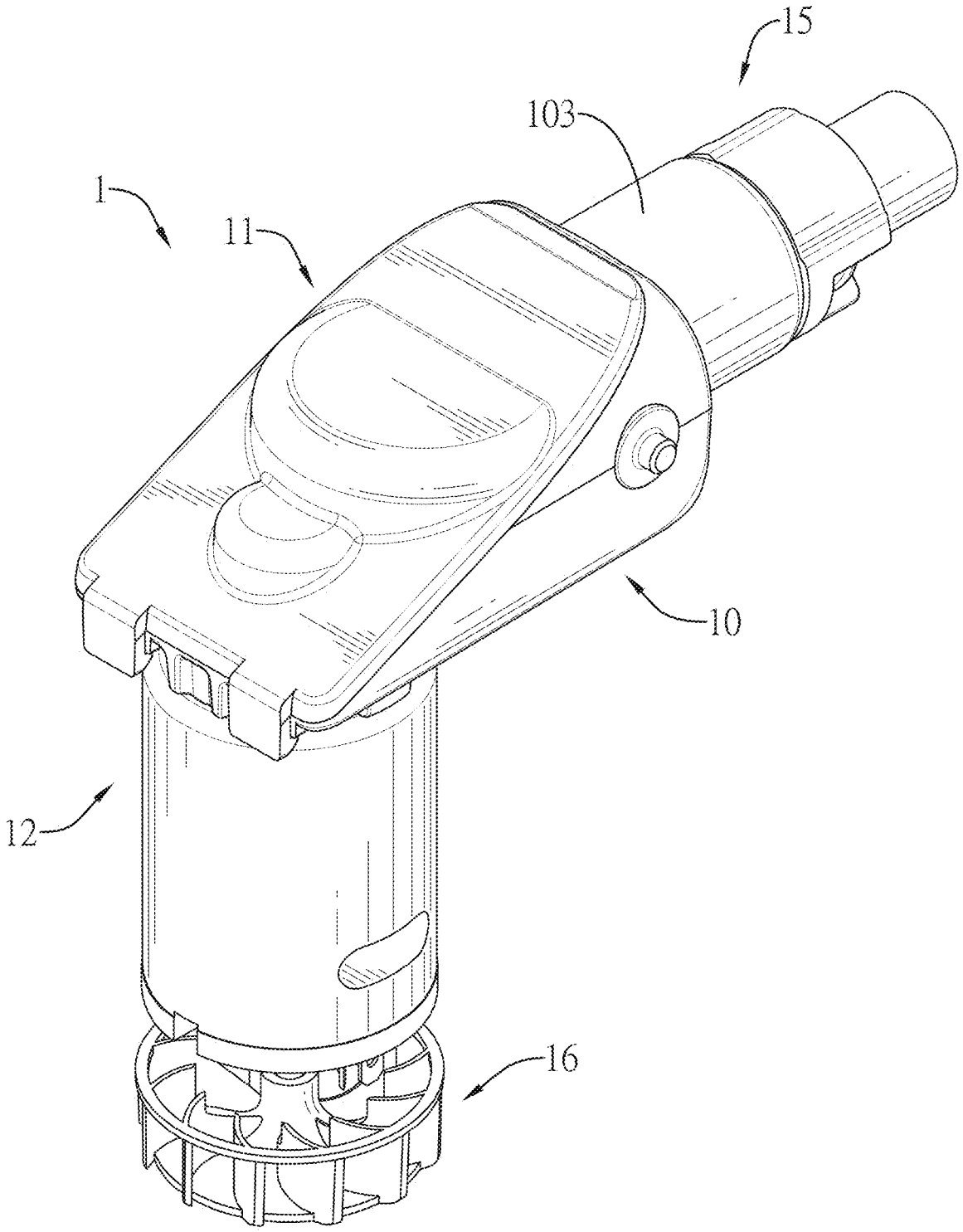
FIG. 9 is a perspective view of the core of the inflatable pump disposed in the housing in FIG. 3 or 7.
Figure 10:
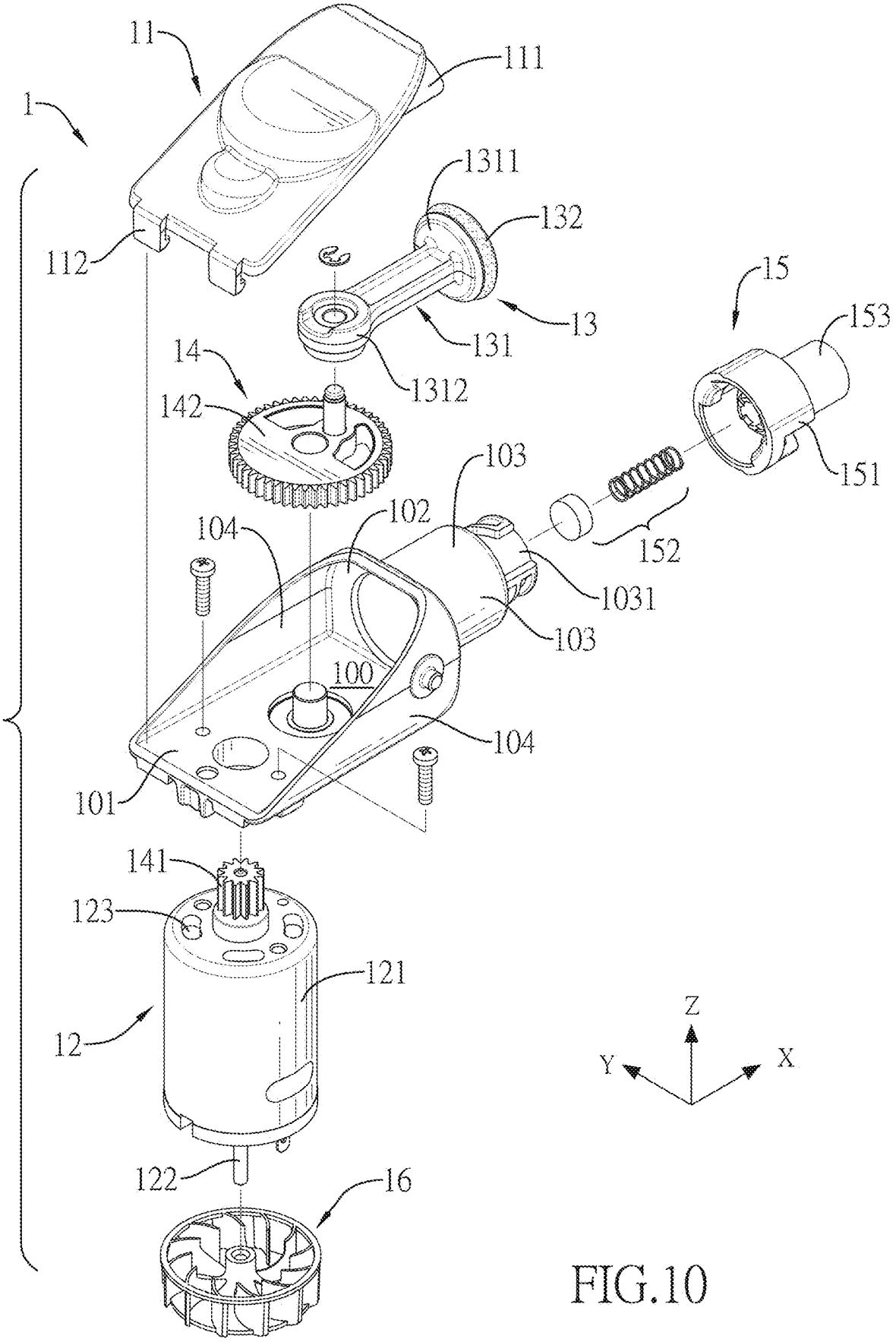
FIG. 10 is an exploded perspective view of the core of the inflatable pump in FIG. 9.

With reference to FIGS. 9 and 10, the core 1 comprises a casing base 10, a casing cover 11, an electric motor 12, a piston rod 13, a transmission set 14, an inflation adapter 15, and a said fan wheel 16.

With reference to FIGS. 9 to 12, an X-axis, a Y-axis, and a Z-axis being perpendicular to one another in there-dimensional space are defined in the casing base 10. The casing base 10 comprises a base portion 101, a rear portion 102, a cylinder portion 103, and two triangular sidewall portions 104. The rear portion 102 is formed at an end of the base portion 101 on the X-axis and extends along the Z-axis. A transmission space 100 is formed between the base portion 101 and the rear portion 102. The cylinder portion 103 is integrally formed with the rear portion 102 and extends along the X-axis away from the base portion 101. The cylinder portion 103 has a cylinder chamber fluidly communicating with the transmission space 100 through the rear portion 102. A connection end portion 1031 is formed at an end of the cylinder portion 103 away from the rear portion 102. The two triangular sidewall portions 104 are respectively located at two opposite sides of the transmission space 100 on the Y-axis and extend along the X-axis from the rear portion 102 to the other end of the base portion 101. Because the two triangular sidewall portions 104 are respectively located at the two opposite sides of the transmission space 100 on the Y-axis and connected to the base portion 101 and the rear portion 102, the mechanical strength around the base portion 101 and the rear portion 102 of the casing base 10 is enhanced. Accordingly, the casing base 10 can be formed as a triangular enclosure with sloping, thereby decreasing material usage, lowering costs, and lowering weight thereof. In addition, since the cylinder portion 103 is integrally formed with the rear portion 102, the structure thereof is simplified, assembling convenience is enhanced, and an assembly step of a separation cylinder part assembled to a side of a conventional base is omitted.

With reference to FIGS. 9 to 12, the casing cover 11 is detachably disposed on the casing base 10. A rim of the casing cover 11 closely attaches to a rim of the casing base 10 around the base portion 101, the rear portion 102, and the two triangular sidewall portions 104. The casing cover 11 may be secured on the casing base 10 via snap-fit joints or fasteners. In the embodiment, the casing cover 11 is secured on the casing base 10 via snap-fit joints for ease of assembly and detachment. The casing cover 11 tightly covers an opening of the transmission space 100 of the casing base 10 to form a closed room.

With reference to FIGS. 9 and 10, the casing cover 11 has a mounting portion 111 at an end of the casing cover 11 facing toward the rear portion 102 and at least one hook 112 at an opposite end of the casing cover 11 facing away from the rear portion 102. The casing cover 11 is secured on the casing base 10 with a connection of the mounting portion 111 and the rear portion 102 of the casing base 10 and snap-fit joints of the at least one hook 112 and the end of the base portion 101 away from the rear portion 102.

Figure 12:
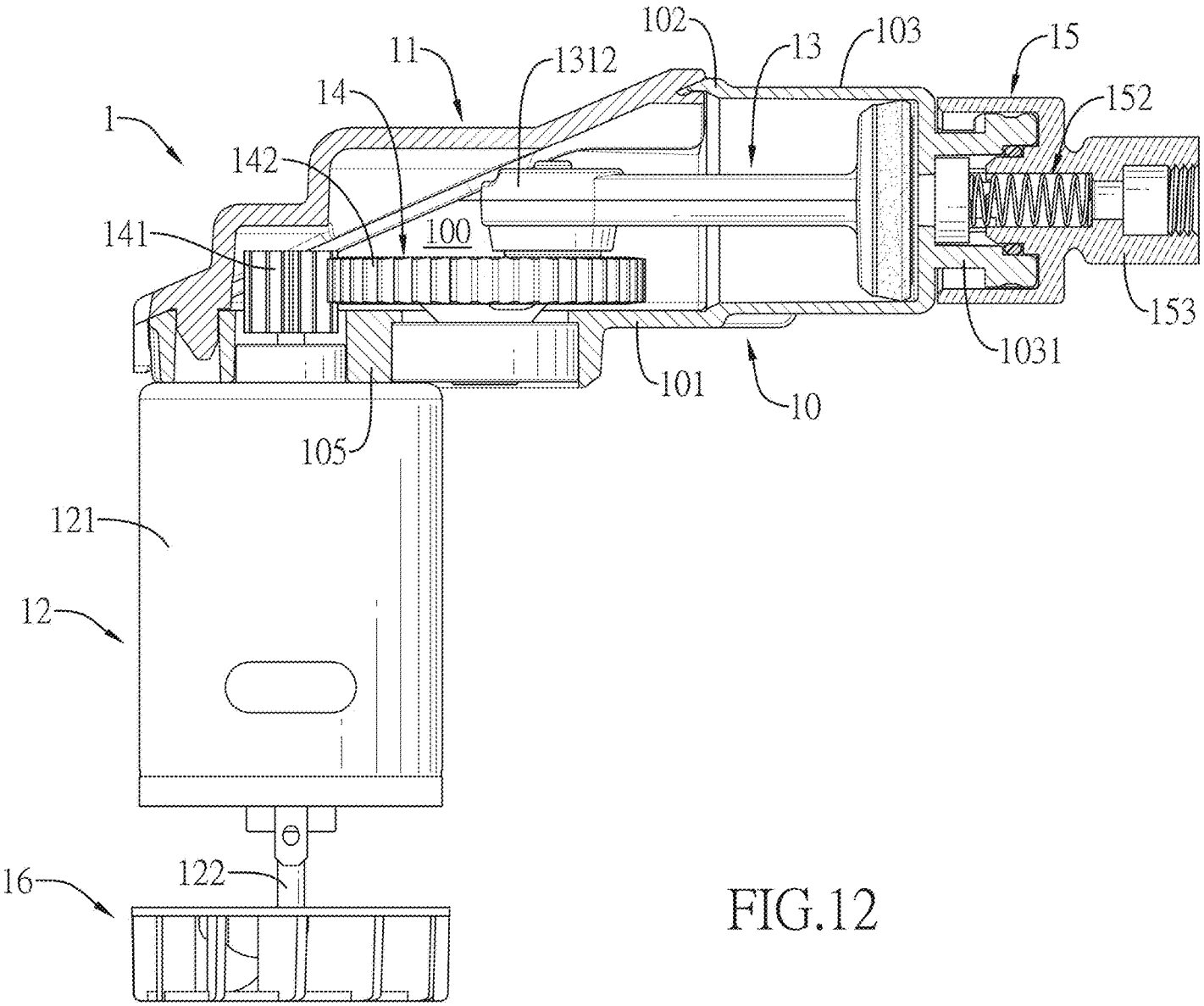
FIG. 12 is another side view in partial section of the core of the inflatable pump in FIG. 9.
Figure 13:
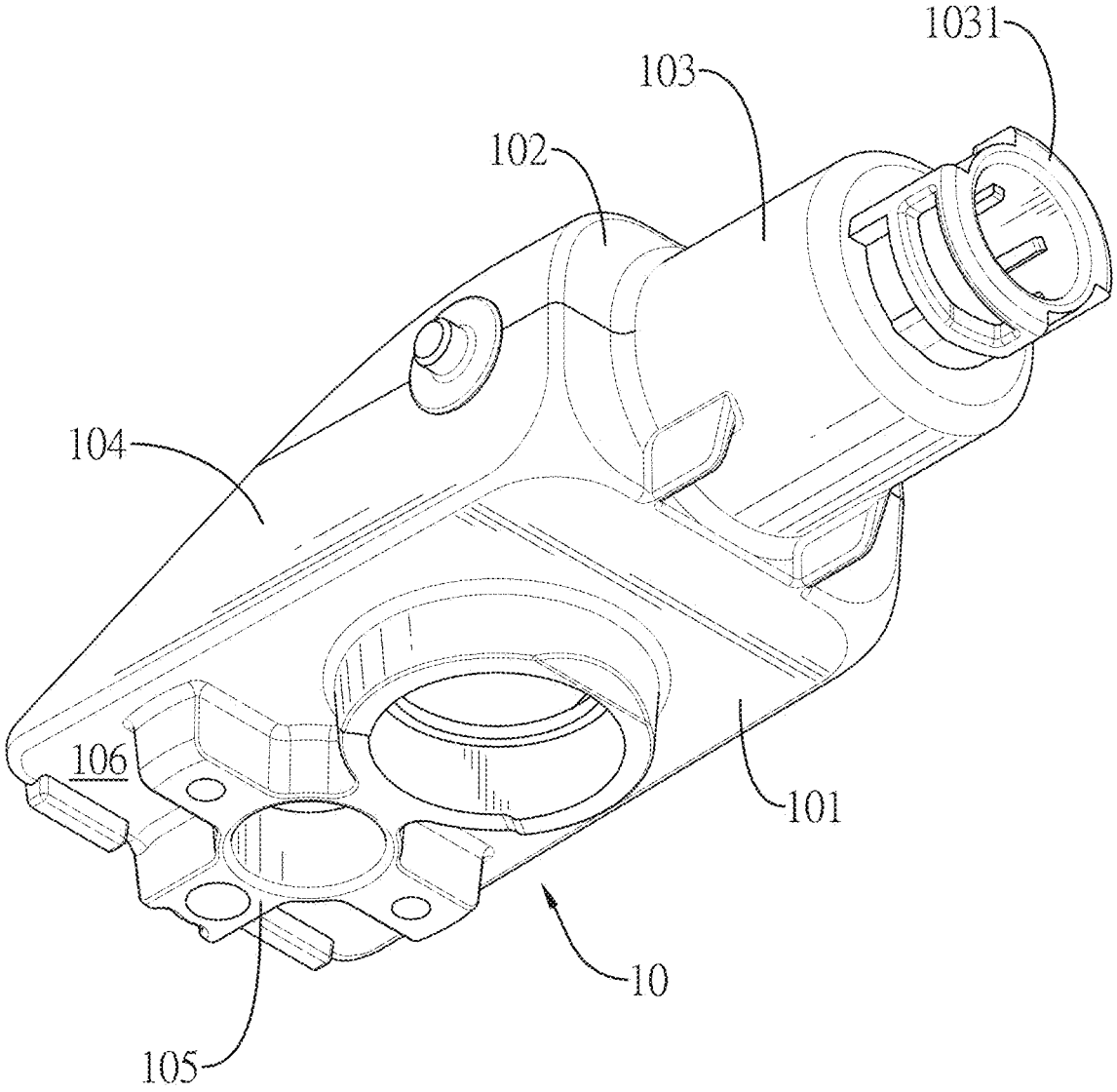
FIG. 13 is a perspective view of a casing base of the core in FIG. 9.
Figure 14:
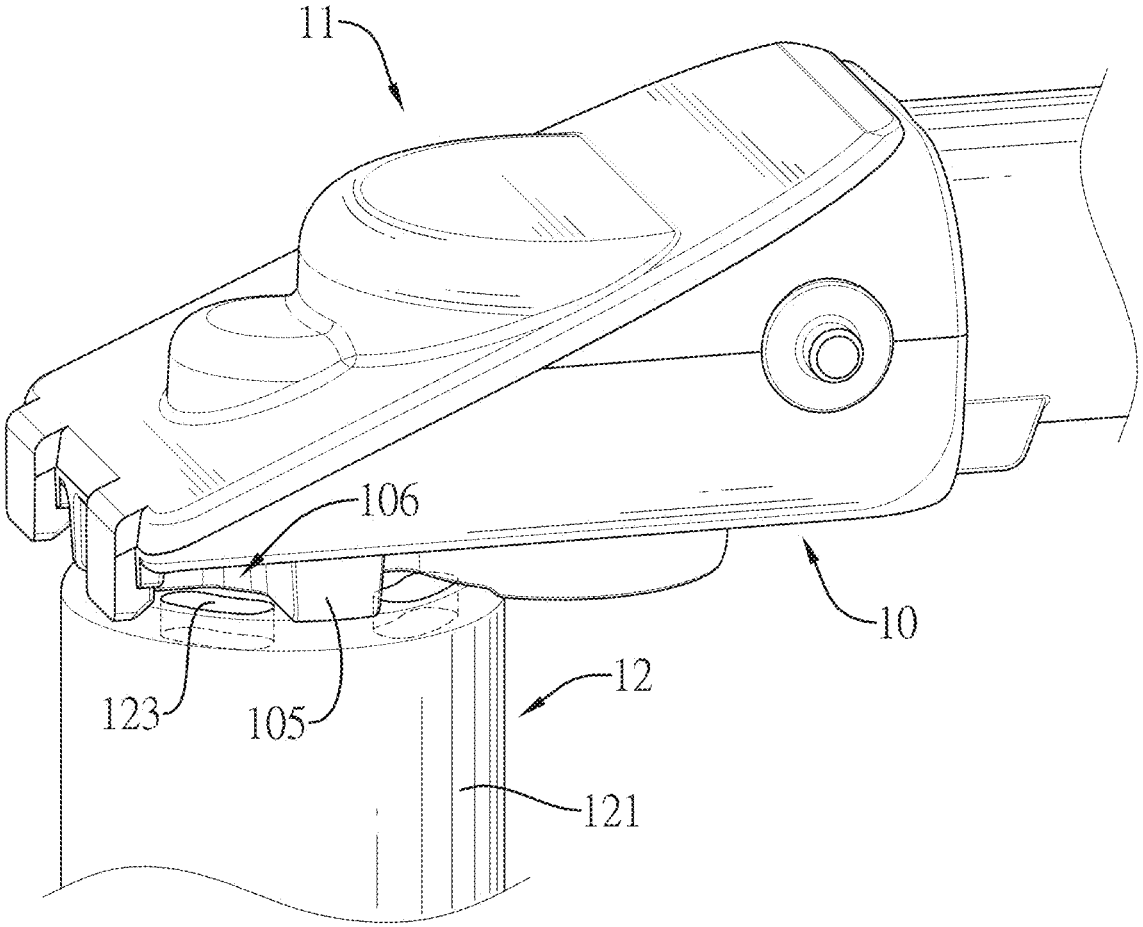
FIG. 14 is an enlarged perspective view of the core in FIG. 9.

With reference to FIGS. 9, 10, and 12, the electric motor 12 is disposed to a side of the base portion 101 of the casing base 10 away from the casing cover 11 and is secured to the casing base 10 via fasteners such as bolts. The electric motor 12 comprises a motor housing 121, a stator disposed in the motor housing 121, and a rotor 122 in the motor housing 121 and rotatably disposed through the stator. An end of the rotor 122 extends through the base portion 101 and extends into the transmission space 100. The fan wheel 16 is disposed at the other end of the rotor 122.

With reference to FIGS. 10, and 12 to 14, the motor housing 121 of the electric motor has at least one ventilation hole 123 formed through a side of the motor housing 121 facing toward the base portion 101. The casing base 10 has a propped block 105 formed on the side of the base portion 101 facing away from the transmission space 100 to form at least one exhausting zone 106 next to the propped block 105. The propped block 105 abuts against the motor housing 121 of the electric motor 12. The at least one ventilation hole 123 corresponds to the at least one exhausting zone 106 in position. Thermal flow generated by the operating electric motor 12 may be cast out through the at least one ventilation hole 123 of the motor housing 121 and the exhausting zone 106. In the embodiment, the propped block 105 is a cruciform block with four arms. The rotor 122 of the electric motor 12 is supported at a center of the cruciform propped block 105. A respective exhausting zone 106 is formed between each adjacent two of the four arms of the propped block 105. The electric motor 12 is stably supported by the propped block 105 of the casing base 10 with good heat dissipation.

Figure 11:
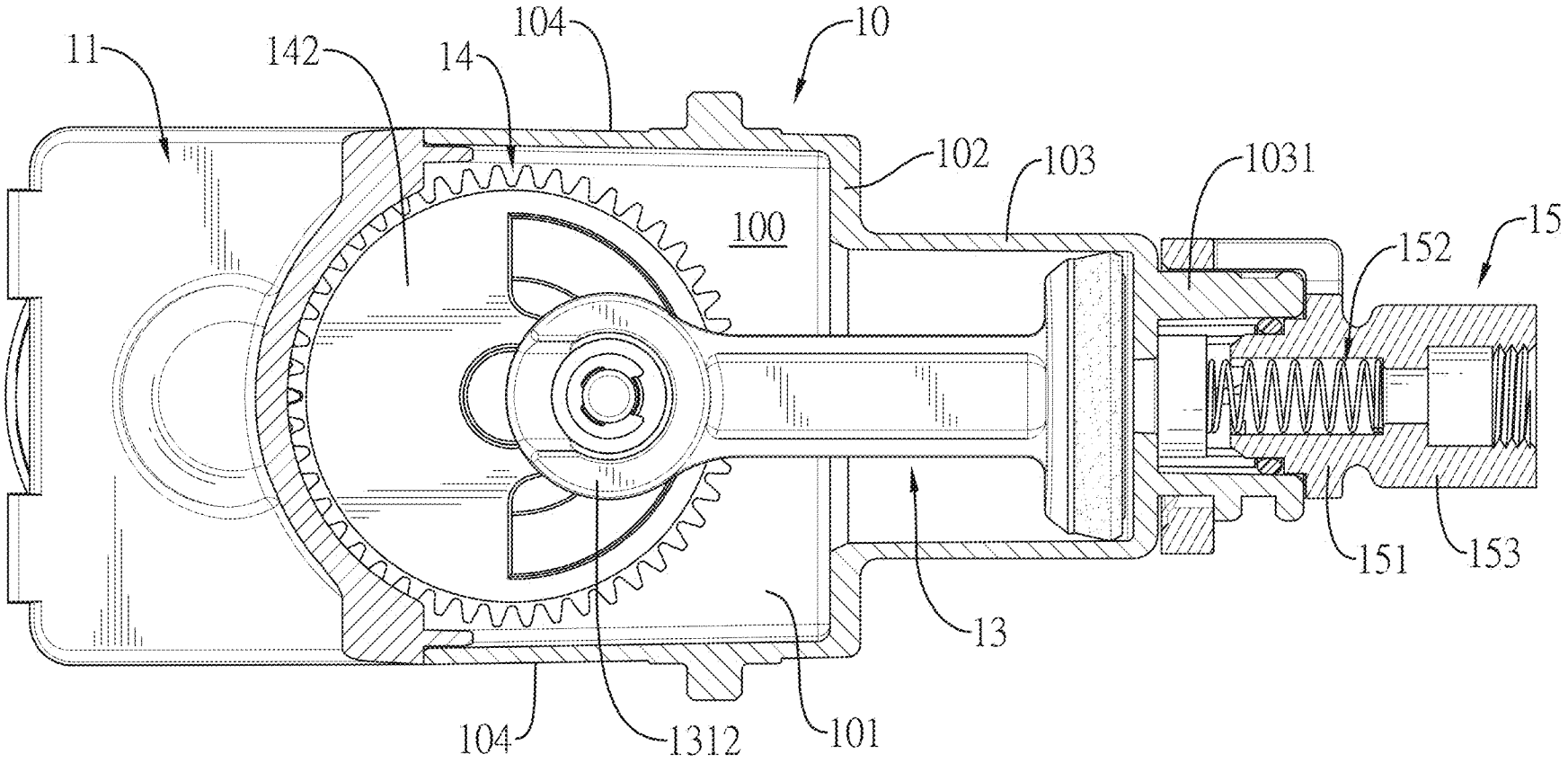
FIG. 11 is a side view in partial section of the core of the inflatable pump in FIG. 9.

With reference to FIGS. 10 to 12, the piston rod 13 is linearly, reciprocally, and movably disposed in the cylinder portion 103 of the casing base 10 and extends into the transmission space 100. In the embodiment, the piston rod 13 has a piston segment 131 and a piston ring 132. The piston segment 131 has a piston head 1311 at one end thereof and a pivot end 1312 at the other end thereof. The piston ring 132 surrounds the piston head 1311 and tightly contacts an internal peripheral surface of the cylinder portion 103. The pivot end 1312 is disposed in the transmission space 100.

With reference to FIGS. 10 to 12, the transmission set 14 is disposed in the transmission space 100 of the casing base 10 and is disposed between and connected with the piston rod 13 and the rotor 122 of the electric motor 12. The piston rod 13, in the cylinder portion 103 of the casing base 10, is driven to move linearly and reciprocally by the electric motor 12. In the embodiment, the transmission set 14 comprises a driving gear 141 and a driven gear 142. The driving gear 141 is disposed at the end of the rotor 122 of the electric motor 12 extending in the transmission space 100. The driven gear 142 is rotatably disposed on the base portion 101 of the casing base 10 and engages with the driving gear 141. The piston rod 13 is eccentrically connected to and is pivotable relative to the driven gear 142 via the pivot end 1312. The driving gear 141 is a small gear, and the driven gear 142 is a large gear being larger than the driving gear 141 in size. The driven gear 142 has a hollow portion adjacent to the eccentric position being connected with the piston rod 13, thereby decreasing material usage thereof, lowering weight, and lowering load on the electric motor 12.

With reference to FIGS. 2 and 10 to 12, the inflation adapter 15 is disposed at the connection end portion 1031 of the cylinder portion 103 of the casing base 10, is exposed from the housing 2, and comprises an adapter body 151 and a check valve 152 disposed in the adapter body 151. The adapter body 151 has an inflating end 153 at an end away from the cylinder portion 103. The check valve 152 is configured to control unidirectional discharge of compressed air from the cylinder portion 103 to the inflating end 153.

With reference to FIGS. 2 to 5, 7, and 8, the fan wheel 16 is disposed in the volute chamber 230 of the fan chamber 23 of the housing 2 and is disposed at the other end of the rotor 122 of the electric motor 12. Preferably, the fan wheel 16 may be selected as a centrifugal fan wheel, so air is directed and enters the fan wheel 16 along an axis of the fan wheel 16 and is cast out by the centrifugal force along a circumferential direction of the fan wheel 16. The air with heat in the core chamber 22 of the housing 2 is directed into the volute chamber 230 of the fan chamber 23 through the communication hole 261 at the partition wall 26 and is cast out of the housing 2 via the outlet 25 with the arrangement of the fan wheel 16 disposed in the volute chamber 230.

With reference to FIGS. 2 to 5, 7, and 8, when said pump is in use, an inflation conduit is connected to the inflating end 153 of the inflation adapter 15 and has a connector at an end thereof. The connector is connected to an inflatable object, such as a tire. The electric motor 12 of the core 1 is turned on via the switch. The piston rod 13 is driven to move linearly and reciprocally within the cylinder portion 103 of the casing base 10 via the transmission set 14 to generate compressed air. The compressed air is conducted into the inflatable object via the inflation adapter 15 and the inflation conduit. In addition, during operation of the electric motor 12, the fan wheel 16 is driven to spin to direct air entering the housing 2 via the inlet 24. Heat around the external surface of the core 1 is carried by the air passing the core 1, is directed from the core chamber 22 to the volute chamber 230 of the fan chamber 23 with the air, and is rapidly cast out from the housing 2 via the outlet 25 by the vortical flow generated by the rotation of the fan wheel 16 in the volute chamber 230.

According to the above-mentioned features and structural relationships of the housing 2 and the inflatable pump with the housing 2, the housing 2 comprises the core chamber 22 divided by the separating wall 20, the inlet 24 at an end of the core chamber 22, the fan chamber with the volute chamber 230 disposed at the other end of the core chamber 22, and the outlet 25 fluidly communicating with the fan chamber 23 to form as a flowing passage for directing air. The core 1 is disposed in the core chamber 22, and the fan wheel 16 on the electric motor is disposed in the volute chamber 230 of the fan chamber 23. When the electric motor 12 is turned on, the fan wheel 16 is driven to spin, cool air is directed to enter the housing 2 via the inlet 24 and carries heat around the core 1 while passing the core 1. The air with heat is directed to enter the volute chamber 230 of the fan chamber 23 from the core chamber 22 and is rapidly cast out via the outlet 25 by the vortical flow generated by the rotation of the fan wheel 16 in the volute chamber 230. The cooling efficiency is enhanced with the arrangement of the fan wheel 16 in the housing 2. In addition, since the storage chamber 21 and the core chamber 22 are separated by the separating wall 20, the heat generated by the operating core 1 in the core chamber 22 is blocked by the separating wall 20 to prevent from transferring to the power storage unit 3 or the electric cable with plug disposed in the storage chamber 21. Operation safety for the power storage unit 3, the electric cable, and the inflatable pump is ensured.

The casing base 10 of the core 1 of the inflatable pump has the cylinder portion 103 integrally formed with the rear portion 102 and is formed as the triangular enclosure structure with sloping constructed by the two triangular sidewall portions 104 at the two opposite sides of the base portion 101 and rear portion 102. The connection strength between the cylinder portion 103 and the rear portion 102 is enhanced. Dissipation of heat generated by the movement of the piston rod 13 in the cylinder portion 103 is enhanced. The service life of the core 1 of the inflatable pump is prolonged. Material of the casing base 10 may be reduced to lower cost and weight. The structure of the casing base 10 is simplified. The assembling convenience is enhanced. An assembling step for assembling separation cylinder part to a rear portion of a conventional base can be omitted. In addition, since an opening of the transmission space 100 of the casing base 10 is tightly closed by the casing cover 11 to form a closed room, noise generated during operation of the transmission set 14 and the piston rod 13 in the casing base 10 is prevented from spreading outward, thereby lowering the noise.

The casing cover 11 is connected to the casing base 10 via snap-fit joints for ease of assembly and lowering costs.

The casing base 10 of the core 1 may further comprise the propped block 105 formed on the side of the base portion 101 away from the transmission space 100 and the at least one exhausting zone 106 next to the propped block 105. The propped block 105 abuts against the motor housing 121 of the electric motor 12 with the at least one ventilation hole 123 directly facing to the at least one exhausting zone 106 in position. Therefore, the thermal flow generated by the operating electric motor 12 may exhaust to said exhausting zone 106 via said ventilation hole 123. In addition, the propped block 105 may be a cruciform block with four arms. The rotor 122 of the electric motor 12 is supported at the center of the cruciform propped block 105. A respective exhausting zone 106 is formed between two adjacent arms. The electric motor 12 is stably supported by the propped block 105 of the casing base 10 with good heat dissipation.

What is claimed is:

1. An inflatable pump comprising:

a housing comprising:

a separating wall formed in the housing to separate an interior of the housing into a storage chamber, a core chamber, and a fan chamber; and an inlet formed through a side of the housing and fluidly communicating with the core chamber at one of two ends of the core chamber;

an outlet formed through another side of the housing and fluidly communicating with the fan chamber;

the fan chamber fluidly communicating with the core chamber at the other one of the two ends of the core chamber;

a volute chamber facing toward the outlet formed in the fan chamber; and the inlet fluidly communicating with the outlet via the core chamber and the fan chamber to form a flowing passage in the housing;

a core disposed in the core chamber of the housing and extending into the fan chamber, the core comprising:

a casing base comprising:

a base portion having two ends;

a rear portion formed at one of the two ends of the base portion;

a transmission space formed between the rear portion and the base portion;

a cylinder portion formed at the rear portion, extending away from the base portion, and having a connection end portion; and two triangular sidewall portions respectively formed at two opposite sides of the transmission space between the base portion and the rear portion, extending from the rear portion to the other one of the two ends of the base portion;

a casing cover detachably and tightly disposed on the casing base and closing the transmission space;

an electric motor, disposed at the base portion of the casing base, comprising a rotor having one of two ends extending into the transmission space of the casing base;

a piston rod disposed in the cylinder portion of the casing base and extending into the transmission space of the casing base;

a transmission set disposed in the transmission space of the casing base and connected between the piston rod and the rotor of the electric motor;

an inflation adapter disposed at the connection end portion of the cylinder portion of the casing base; and a fan wheel disposed in the volute chamber in the fan chamber of the housing and disposed at the other one of the two ends of the rotor of the electric motor.

2. The inflatable pump as claimed in claim 1, wherein an internal surface of the fan chamber is formed as a volute guide plate for forming the volute chamber facing toward the outlet within the fan chamber.

3. The inflatable pump as claimed in claim 1, wherein a volute wind cover is disposed in the fan chamber of the housing, and the volute chamber facing toward the outlet is within the volute wind cover.

4. The inflatable pump as claimed in claim 1, wherein the housing comprises a through hole formed through the side of the housing with the inlet and fluidly communicating with the core chamber.

5. The inflatable pump as claimed in claim 1, wherein one of a power storage unit and an electric cable with a plug is electrically connected to the electric motor and is disposed in the storage chamber of the housing.

6. The inflatable pump as claimed in claim 2, wherein one of a power storage unit and an electric cable with a plug is electrically connected to the electric motor and is disposed in the storage chamber of the housing.

7. The inflatable pump as claimed in claim 3, wherein one of a power storage unit and an electric cable with a plug is electrically connected to the electric motor and is disposed in the storage chamber of the housing.

8. The inflatable pump as claimed in claim 4, wherein one of a power storage unit and an electric cable with a plug is electrically connected to the electric motor and is disposed in the storage chamber of the housing.

9. The inflatable pump as claimed in claim 1, wherein the casing cover is secured on the casing base via snap-fit joints.

10. The inflatable pump as claimed in claim 2, wherein the casing cover is secured on the casing base via snap-fit joints.

11. The inflatable pump as claimed in claim 3, wherein the casing cover is secured on the casing base via snap-fit joints.

12. The inflatable pump as claimed in claim 4, wherein the casing cover is secured on the casing base via snap-fit joints.

13. The inflatable pump as claimed in claim 1, wherein the transmission set comprises a driving gear and a driven gear;

the driving gear is disposed at the rotor of the electric motor;

the driven gear is rotatably disposed at the base portion of the casing base and engages with the driving gear; and the piston rod is eccentrically connected to and is pivotable relative to the driven gear.

14. The inflatable pump as claimed in claim 5, wherein the electric motor comprises a motor housing having at least one ventilation hole formed through a side of the motor housing facing toward the base portion;

the rotor is disposed in the motor housing;

the casing base has a propped block formed on a side of the base portion facing away from the transmission space to form at least one exhausting zone next to the propped block;

the propped block abuts against the motor housing; and the at least one ventilation hole corresponds to the at least one exhausting zone in position.

15. The inflatable pump as claimed in claim 9, wherein the electric motor comprises a motor housing having at least one ventilation hole formed through a side of the motor housing facing toward the base portion;

the rotor is disposed in the motor housing;

the casing base has a propped block formed on a side of the base portion facing away from the transmission space to form at least one exhausting zone next to the propped block;

the propped block abuts against the motor housing; and the at least one ventilation hole corresponds to the at least one exhausting zone in position.

16. The inflatable pump as claimed in claim 14, wherein the propped block is a cruciform block with four arms;

the rotor of the electric motor is supported at a center of the propped block; and a respective said exhausting zone is formed between each adjacent two of the four arms.

* * * * *